US011828106B2

(12) United States Patent
Riesenberg et al.

(10) Patent No.: US 11,828,106 B2
(45) Date of Patent: Nov. 28, 2023

(54) SLAT SYSTEM AND CASE FURNITURE

(71) Applicant: Ludewig GmbH, Bünde (DE)

(72) Inventors: Andre Riesenberg, Hiddenhausen (DE); Bernd Fiolka, Melle (DE)

(73) Assignee: Ludewig GmbH, Bünde (DE)

( * ) Notice: Subject to any disclaimer, the term of this patent is extended or adjusted under 35 U.S.C. 154(b) by 350 days.

(21) Appl. No.: 17/273,154

(22) PCT Filed: Sep. 12, 2019

(86) PCT No.: PCT/EP2019/074300
§ 371 (c)(1),
(2) Date: Mar. 3, 2021

(87) PCT Pub. No.: WO2020/053320
PCT Pub. Date: Mar. 19, 2020

(65) Prior Publication Data

US 2021/0340811 A1 Nov. 4, 2021

(30) Foreign Application Priority Data

Sep. 14, 2018 (DE) ..... 202018105280.2
Oct. 19, 2018 (DE) ..... 202018106012.0

(51) Int. Cl.
*E06B 9/06* (2006.01)
*A47B 96/00* (2006.01)
(Continued)

(52) U.S. Cl.
CPC ..... *E06B 9/115* (2013.01); *A47B 96/00* (2013.01); *E06B 5/006* (2013.01); *E06B 9/0661* (2013.01);
(Continued)

(58) Field of Classification Search
CPC ..... E06B 9/115; E06B 9/0661; E06B 2009/1572; E06B 9/0676; E06B 9/0638; E06B 5/006; A47B 96/00; E05Y 2900/20
See application file for complete search history.

(56) References Cited

U.S. PATENT DOCUMENTS 9,637,964 B1 5/2017 Kun
9,637,966 B1 5/2017 Kun
2017/0183901 A1 6/2017 Kun

FOREIGN PATENT DOCUMENTS

DE 202016106223 U1 * 3/2018 ..... E06B 9/11
DE 202019105632 U1 * 2/2021 ..... E06B 9/0676
(Continued)

OTHER PUBLICATIONS

WIPO, International Search Report (on the priority application), Oct. 22, 2019.

*Primary Examiner* — Kimberley S Wright
(74) *Attorney, Agent, or Firm* — Laurence P. Colton; SMITH TEMPEL BLAHA LLC

(57) ABSTRACT

A slat system having a slat hanging with slats and a shifting apparatus for shifting the slats. The slats are intercoupled and movable from a closed position, in which broad faces of the slats are substantially flush in a plane and narrow faces of adjacent slats face one another, into an open position, in which the broad faces of the slats are parallel to one another but not parallel to an opening and closing direction, using the shifting apparatus to shift the slats in the opening and closing direction. The shifting apparatus has a pulling means coupled at one end to the slat hanging. The slat system has a first sheave mounted so as to be rotatable about an axis in two directions, to which sheave the other end of the pulling means is fastened, and a locking means to block the sheave from rotating in the open position.

20 Claims, 7 Drawing Sheets

(51) Int. Cl.

| | |
|---|---|
| ***E05D 15/26*** | (2006.01) |
| ***E06B 9/11*** | (2006.01) |
| ***E06B 5/00*** | (2006.01) |
| *A47B 43/00* | (2006.01) |
| *E06B 9/15* | (2006.01) |
| *E05F 15/605* | (2015.01) |

(52) U.S. Cl.
CPC ..... *A47B 43/00* (2013.01); *E05F 15/605* (2015.01); *E05Y 2900/20* (2013.01); *E06B 2009/1572* (2013.01)

(56) References Cited

FOREIGN PATENT DOCUMENTS

| | | | | |
|---|---|---|---|---|
| DE | 202020103730 | U1 | * | 11/2021 |
| EP | 1516997 | A2 | | 3/2005 |

* cited by examiner

SLAT SYSTEM AND CASE FURNITURE

CROSS REFERENCE TO RELATED APPLICATIONS

This patent application is the US National Phase of and claims priority on and the benefit of International Application No. PCT/EP2019/074300 having an international filing date of 12 Sep. 2019, which claims priority on and the benefit of German Patent Application No. 20 2018 105 280.2 having a filing date of 14 Sep. 2018 and German Patent Application No. 20 2018 106 012.0 having a filing date of 19 Oct. 2018.

BACKGROUND OF THE INVENTION

Technical Field

The invention relates to a slat system having a slat hanging which comprises a plurality of slats and a shifting apparatus for shifting the slats, the plurality of slats being intercoupled such that they can be moved from a closed position, in which the broad faces of the slats are substantially flush in a plane parallel to an opening and closing direction and narrow faces of adjacent slats face one another, into an open position, in which the broad faces of the slats are in particular parallel to one another but not parallel to the opening and closing direction, by means of the shifting apparatus and by the slats being shifted in the opening and closing direction, and the shifting apparatus comprising at least one pulling means which is coupled at one end to the slat hanging, and to a cabinet which comprises a slat system of this type.

Prior Art

Providing cabinets in particular with doors composed of slats is known. One example is the classic Venetian blind, which comprises a sheet consisting of interconnected slats guided in a furniture body. Moreover, a slat system in which the classic Venetian blind sheet is replaced by an arrangement consisting of slats which are guided so as to be mutually parallel and are moved by means of a transmission arrangement arranged on the ends of the slats has previously been established. The latter arrangement in particular has the visual advantage that the entire slat door can essentially be arranged in front of the furniture body. Therefore, no space is lost inside the furniture body for accommodating slats in the open state. A drive motor that actuates the transmission arrangement, which is usually designed as a scissor transmission, is used in order to bring the slat system into the open position or into the closed position.

BRIEF SUMMARY OF THE INVENTION

The problem addressed by the present invention is that of further developing a slat system of the type mentioned at the outset, and of providing a cabinet which does not require a motorized drive.

This problem is solved by a slat system, having a slat hanging which comprises a plurality of slats, said system also having a shifting apparatus for shifting the slats, the plurality of slats being intercoupled such that they can be moved from a closed position, in which the broad faces of the slats are substantially flush in a plane parallel to an opening and closing direction and narrow faces of adjacent slats face one another, into an open position, in which the broad faces of the slats, in particular of each of the slats, are in particular parallel to one another but not parallel to the opening and closing direction, by means of the shifting apparatus and by the slats being shifted in the opening and closing direction; and the shifting apparatus comprising at least one pulling means which is coupled at one end to the slat hanging, characterized in that the slat system further comprises at least one first sheave which is mounted so as to be rotatable about an axis in two directions, to which sheave the other end of the pulling means is fastened, at least one locking means which is designed to block the sheave (23) from rotating in the open position being arranged on the sheave. The problem is further solved by a cabinet comprising a furniture body and a frontal opening and a slat system as disclosed herein, wherein the slats of the slat system are arranged on the cabinet in such a way that, in the closed state, they close the opening of the cabinet. Advantageous embodiments can be found in the respective dependent claims.

The slat system according to the invention has a slat hanging comprising a plurality of slats, and a shifting apparatus for shifting the slats upward. The plurality of slats are intercoupled such that they can be moved from a closed position, in which the broad faces of the slats are substantially flush in a plane parallel to an opening and closing direction and narrow faces of adjacent slats face one another, into an open position by means of the shifting apparatus and by the slats being shifted in the opening and closing direction. In the open position, the broad faces of the slats, in particular of each of the slats, are in particular parallel to one another but not parallel to the opening and closing direction. The shifting apparatus comprises at least one pulling means which is coupled at one end to the slat hanging. The slats can in principle be made of any desired material, preferably of glass or plastics.

According to the invention, the slat system further comprises at least one sheave mounted so as to be rotatable about an axis in two directions. The other end of the pulling means is fastened to said sheave. At least one locking means which is designed to block the sheave from rotating in the open position is arranged on the sheave.

In this way, it is made possible for the slat hanging to be transferred from the closed position into the open position, where it can be fixed in the open position without requiring a self-locking electrical drive motor or similar.

According to one particular embodiment, the slat system according to the invention can comprise at least one first pulling means and one second pulling means. One end of each of the two pulling means is preferably coupled to the slat hanging.

In this embodiment with two pulling means, each pulling means can in particular also be assigned to a sheave. Therefore, in this embodiment, the slat system according to the invention preferably additionally comprises a second sheave mounted so as to be rotatable about an axis in two directions, the other end of the first pulling means being fastened to the first sheave and the other end of the second pulling means being fastened to the second sheave. With two sheaves, heavier hangings in particular can be advantageously moved. Moreover, in this case, when the sheaves are locked in the open position, a lock can be selected in which the two sheaves can reciprocally hold one other in the open position. According to one particular embodiment of the present invention, at least one, in particular magnetic or magnetizable, locking means which is designed to block relative rotation of the sheaves in the open position can therefore be arranged on each sheave.

According to a preferred embodiment of the present invention, one end of the at least one pulling means (for purposes of symmetry, two pulling means can preferably be provided on the two lateral regions of the slat hanging) is connected to a shifting element that is coupled to the slat hanging. This shifting element can be guided, for example, but does not necessarily have to be. Alternatively, the end of the pulling means can also be directly connected to the slat hanging. According to a preferred embodiment, the shifting element is designed as an entraining means which captures the slat hanging at a suitable point and pulls it along.

The slats are preferably coupled to one another by a scissor transmission. In the design comprising a scissor transmission, the slats can in particular be attached to lever extensions, which are arranged on levers of the scissor transmission that are guided parallel to one another, and which project toward a front of the slat hanging. In this way, good restricted guidance of the individual slats can be achieved. Moreover, it is sufficient here for the pulling means to engage on only one part of the scissor transmission. For example, the shifting element can be coupled to, i.e. fixedly connected to or in contact with, the scissor transmission. The pulling means can, for example, be arranged below the lowermost lever of the scissors and connected to the shifting element, and pull the lowermost lever of the scissors along when moving into the open position. A loose coupling has the advantage that the slat hanging can be removed for maintenance purposes without it being necessary to remove the entire shifting assembly.

In order to lock the slat hanging in the open position and/or in the closed position, according to a preferred embodiment of the invention, the at least one locking means can comprise a magnet and/or a magnetizable, in particular ferromagnetic, material. Of course, other locking means, which should be of the aforementioned nature, are also possible in principle. For example, detent mechanisms or snap mechanisms or the like can of course be used as well. The magnetic variant has the advantage that locking is possible without movement, such that this form of lock will not wear out even if the slat system is opened and closed frequently.

In order to design the slat system according to the invention in an even more flexible manner, the locking means can be designed to be adjustable and in particular fixable in its position on the sheave, in particular by means of a slotted guide system provided in the sheave. In this way, the precise stopping point of the slats in the open position and the closed position can be finely adjusted.

The sheave can furthermore be coupled to a preloading element, in particular a spiral spring. This preloading element can in particular be designed in such a way that the slat hanging is preloaded such that the preloading element assists the movement of the slats into the open position. In this way, it is significantly easier for an operator to manually open a cabinet having the slat system according to the invention.

The invention thus also relates to a cabinet which comprises a furniture body and a frontal opening and a slat system as described above. The slats of the slat system are arranged on the cabinet in such a way that, in the closed state, they close the opening of the cabinet.

On the cabinet according to the invention, an additional counter locking element, as well as the at least one locking means of the sheave, which counter locking element interacts with the locking means of the sheave in order to establish a positional fixing of the slat hanging, can in particular be attached to the furniture body. The sheave is preferably rotatably mounted on the furniture body, in particular on the upper face thereof. According to a preferred embodiment, the aforementioned counter locking element can in particular be attached to an upper face of the cabinet. The counter locking element can comprise a magnetic and/or magnetizable, in particular ferromagnetic, material (as can the locking means on the sheave), such that the locking is brought about by magnetic interaction. Of course, additional locking means can be provided on the sheave or additional counter locking elements can be provided on the furniture body, in particular on an upper face, in particular if fixing the slat hanging in the closed position and/or in an intermediate position is desired.

According to a preferred embodiment of the cabinet according to the invention, the slat hanging is guided, in particular by means of one or two scissor transmissions, in a guiding region of the furniture body on one or both of the lateral walls that delimit the opening. The guiding region can be provided such that it can be inserted into the lateral walls of the furniture body. In this way, a very compact guiding assembly for the slat hanging can be provided.

The aforementioned shifting element can also be shiftably guided in the opening and closing direction in at least one guide that extends parallel to the opening and closing direction. This guide can also be located in the guiding region in which the slat hanging is also guided.

The technology described above comprising the at least one sheave can be used in particular for especially heavy hangings, e.g. in the case of tall cupboards, for additionally attaching a drive motor. In this case, the at least one sheave is mounted on a rotary bearing that is fastened to the upper face. The rotary bearing has a motor connection flange to which a drive motor is fastened. The motor shaft is coupled to the sheave such that the motor can drive the sheave in rotation. In this way, the rotation of the motor shaft is conveyed to the sheave and, due to the resulting torque, greater forces can be conveyed to the pulling means and thus to the hanging. Moreover, the drive can be replaced easily without dismantling the rest of the slat system or the rest of the drive assembly. A particularly maintenance-friendly design can be achieved in this way.

The sheaves used here can have diameters in the range of the body depth of the cabinet.

Advantageously, the axis of rotation of the motor shaft can extend parallel to the axis of rotation of the sheave, and can in particular be identical thereto.

BRIEF DESCRIPTION OF THE DRAWINGS

The invention is described in more detail below with reference to FIGS. 1-7 and the embodiments shown therein.

DETAILED DESCRIPTION OF PREFERRED EMBODIMENTS

Figure 1:
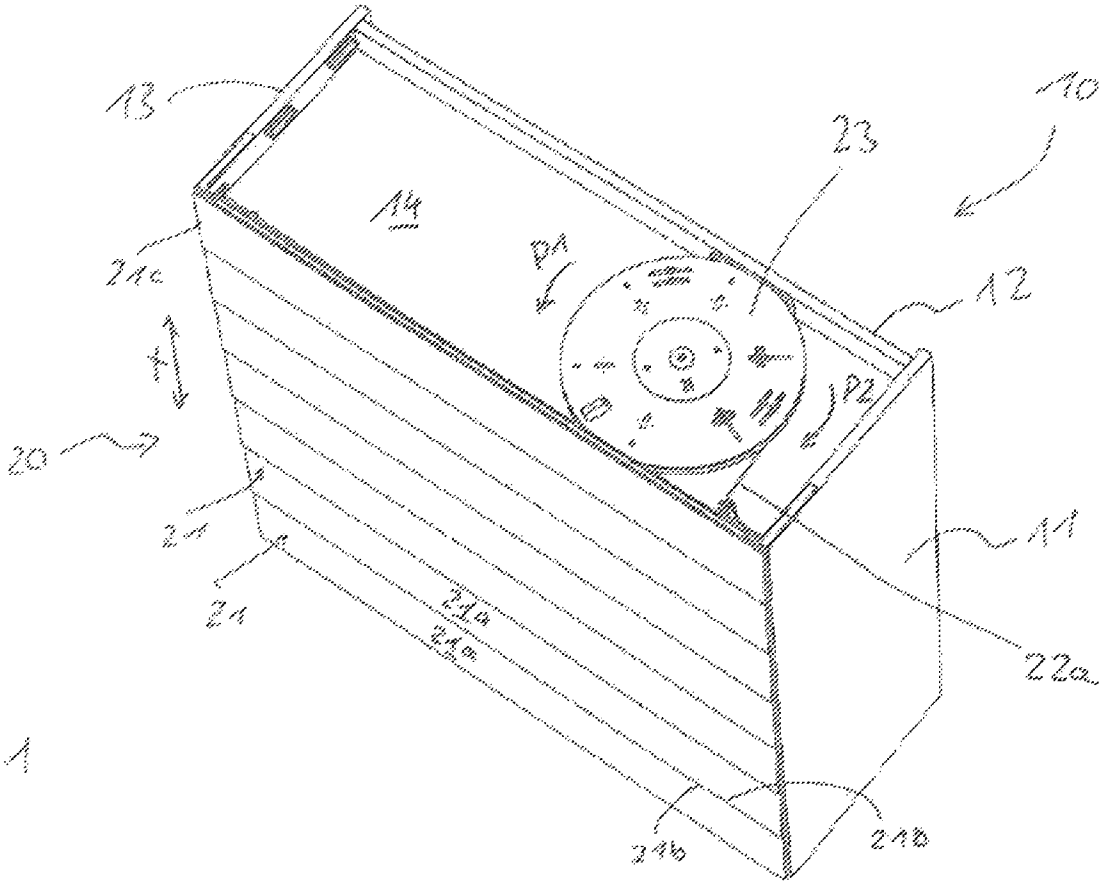
FIG. 1 is a perspective frontal view of a cabinet according to the invention comprising a slat system according to the invention, in which the slat hanging is in a closed position.
Figure 2:
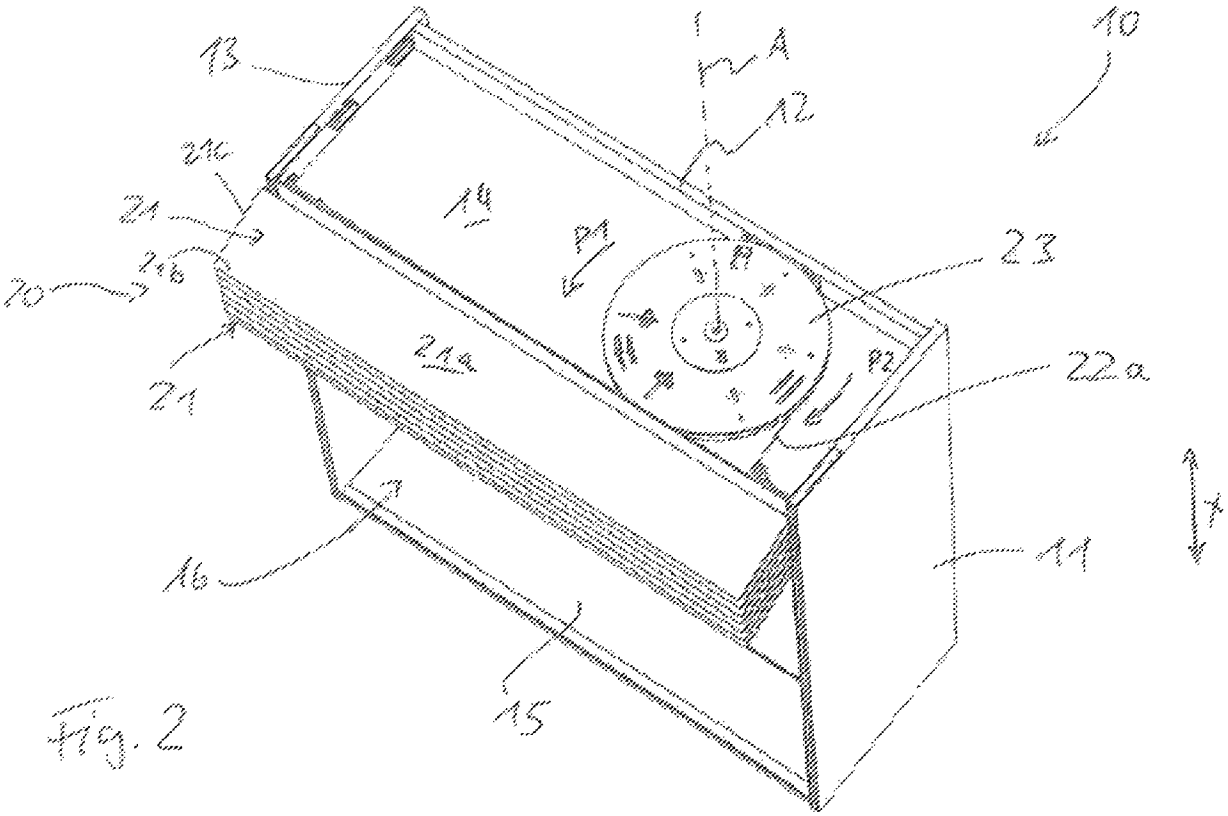
FIG. 2 shows the cabinet according to the invention from FIG. 1 with the slat hanging in the open position.

The cabinet 10 shown in more detail in FIGS. 1-4 is designed as a furniture body, and as such has lateral walls 11, 13, a rear wall 12, an upper face 14 which can be covered by a cover, an underside 15, and an opening 16 at the front, through which opening the interior of the cabinet 10 can be accessed.

The cabinet 10 is equipped with a slat system 20 according to the invention, which involves a hanging consisting of slats 21 that closes the opening 16. The slat system can be opened and closed in an opening and closing direction X. In the closed position shown in FIG. 1, the broad faces 21*a* of the slats 21 are adjacent to one another and flush in a plane. The narrow faces 21*b*, which are broader in the drawing, of adjacent slats 21 face one another. Reference sign 21*c* denotes the narrow faces of the slats 21 that are located on the ends of the slats 21 in the region of the lateral flanks or lateral walls 11 and 13.

Figure 3:
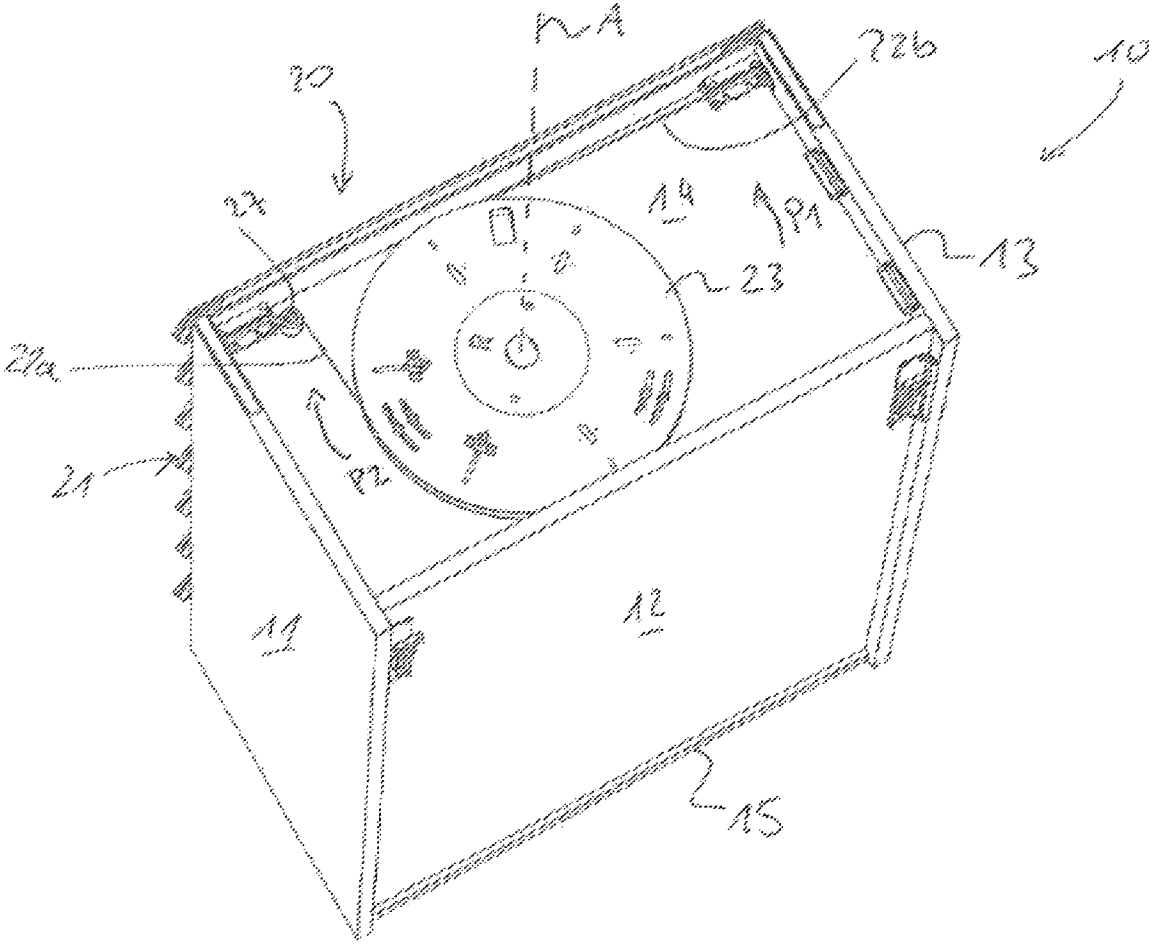
FIG. 3 is a perspective rear view of the cabinet according to the invention from FIGS. 1 and 2, in which the slat hanging is between the open position and the closed position.

The intercoupled slats 21 are coupled, via at least one pulling means 22*a* and 22*b*, which is preferably a pulling cord or pulling tape, to a sheave 23 that is mounted so as to be rotatable in two directions P1, P2, the pulling means 22*a* and 22*b* being guided over the narrow face of the sheave 23. By raising the hanging consisting of slats 21, for example by engaging a handle (not shown here) in the lower region of the cabinet 10, the slats 21 shown in the closed position in FIG. 1 can be moved into the open position shown in FIG. 2 in the direction X. In this process, the sheave 23 rotates about the axis of rotation A in the direction of the arrow P1. Conversely, the sheave 23 mounted on the upper face 14 rotates about the axis of rotation A in the direction of the arrow P2 when the slats 21 are guided from the position shown in FIG. 2 back into the position shown in FIG. 1. In both depicted cases, an intermediate position as shown in FIG. 3 is passed through.

Figure 4:
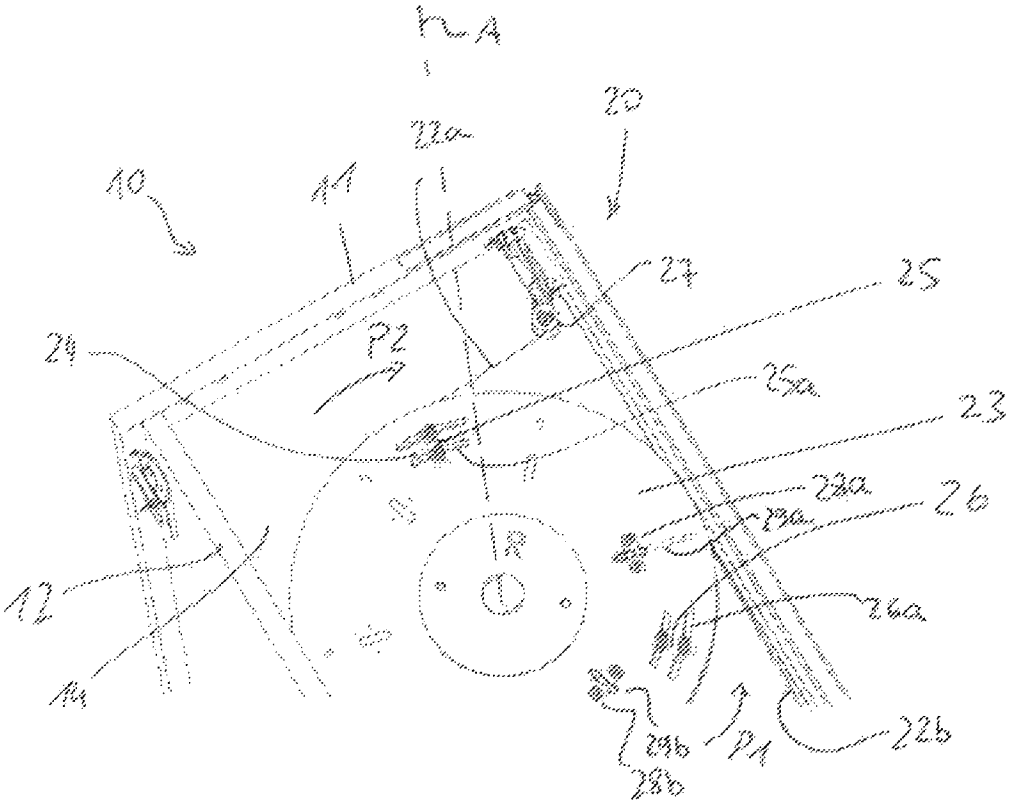
FIG. 4 is an enlarged detail of a perspective plan view of the top of the cabinet according to the invention.

The coupling of the pulling means 22*a*, 22*b* to the sheave 23 and the locking of the sheave 23 are explained in more detail with reference to FIGS. 4 and 5. FIG. 4 shows a position that substantially corresponds to the open position from FIG. 2. In the example shown, the pulling means 22*a* is guided over a deflection roller 27, and one end of said pulling means is fastened to the sheave 23 in the region 28*a*. A slot 29*a* or an adjustment device in general can be installed in the sheave 23 so that the fastening point 28*a* can also be adjusted in the radial direction. This has the advantage that fine adjustment of the length of the pulling means 22*a* is possible. Similar applies to the preferably provided additional pulling means 22*b* with regard to the fastening point 28*b* and the slot 29*b*.

At least in the open position, the hanging formed by the slats 21 should not move back into the closed position by itself as a result of gravitational force. A lock which, at least in the open position, locks the sheave 23 with respect to the upper face 14 of the cabinet 10 is provided for this purpose. A magnet 24 or at least a magnetic material is also fixed to the upper face. A corresponding counter element 25 which is either magnetic or at least magnetizable is located on the sheave 23. Other locks are also possible, of course. If the hanging consisting of slats 21 is opened, the sheave having the element 25 enters the working region of the magnet 24 such that a mutual magnetic attraction which holds the sheave 23 in place and locks it with respect to the upper face 14, where the magnetic interaction is strongest, is brought about between these two elements 24, 25. For fine adjustment, an adjustment slot 25*a* or an adjustment device in general can also be provided on the sheave 23 in the circumferential direction for adjusting the element 25 on the sheave 23.

If the hanging consisting of slats 21 is to be transferred from the open position back into the closed position, the user pulls on the hanging consisting of slats 21 (for example using an aforementioned handle), and thus releases the lock by overcoming the magnetic force or other force exerted by the lock, or by unlatching a latch or the like. The hanging can thus be pulled back into the closed position by an operator.

For this purpose, it can be useful to use a preloading element which preloads the sheave 23. This element is preferably held such that a preload is built up when the hanging moves back into the closed position. This has the advantage that the downward movement of the hanging consisting of slats 21 is slowed down or attenuated so that the hanging does not strike a stop forcefully in the stop position, for example. This preload can also be used to assist the muscle power of the operator that would otherwise be applied against gravitational force when opening the hanging. A spiral spring which is mounted about the axis of rotation A and arranged in the region of the rotary disk 23 is preferably used as the preloading element. Of course, other preloading elements are also possible in principle.

While one end of the pulling means 22*a*, 22*b* is fastened to the sheave 23, the other end of the pulling means engages on the slat system 20 so as to raise said system during opening and slow down said system during closing. The pulling means can be directly connected to the slats 21 or the drive apparatus 30 thereof. In the example shown in FIG. 5, the drive system 30 of the slats comprises a scissor transmission, it being possible (as shown in FIG. 6) for this scissor transmission to be formed by a plurality of levers 31, 32, 34 which are articulated to one another, the levers 31, which are arranged parallel to one another, having an extension 33 which points toward the front 35, and to which the slats 21 are fastened.

Figure 5:
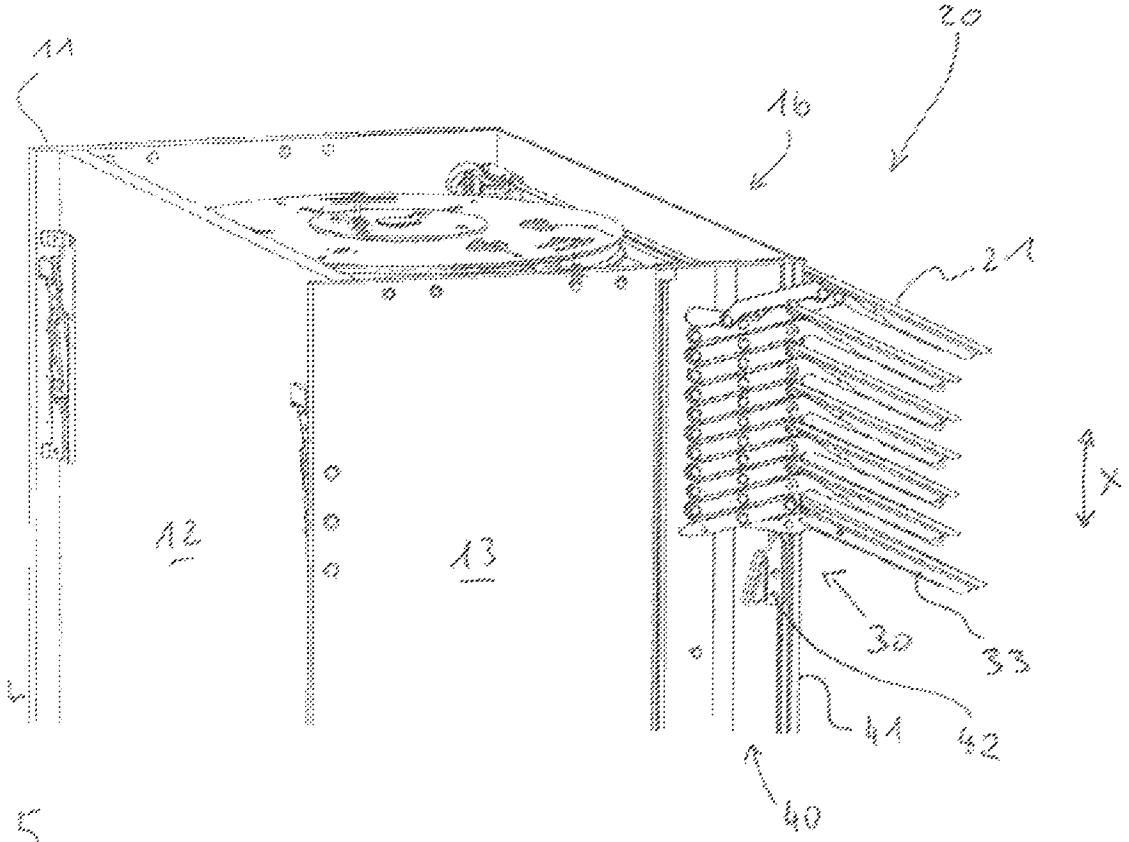
FIG. 5 is a perspective side view of the cabinet according to the invention in the open position, which shows the transmission arrangement that moves the slat hanging.
Figure 6:
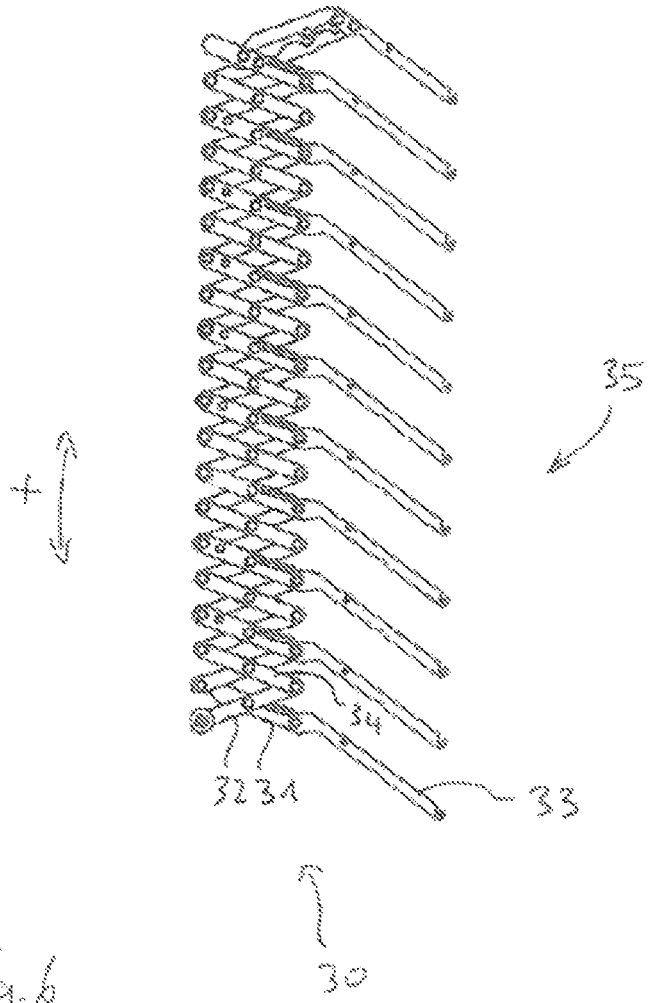
FIG. 6 is a side view of a transmission arrangement suitable for the cabinet according to the invention.

FIG. 5 shows a guiding region 40 on the lateral wall 13 (a corresponding guiding region can also be provided on the opposite lateral wall 11), in which region the scissor transmission 30 is guided, or in any case accommodated. On the end of the scissor transmission 30 which is the lower end in the drawing, a shifting element 42 is provided which is fixedly connected to or in contact with the end of the corresponding pulling means 22*a* or 22*b*. In the example shown, this shifting element 42 abuts the underside of the scissor transmission 30. Therefore, if the sheave is moved in such a way that the hanging consisting of slats 21 opens, the shifting element 42 presses against the scissor transmission and shifts it together so as to achieve the situation shown in FIG. 5. The shifting element 42 is preferably guided in a guide 41 in the region 40. If the lock is released in the open position and the hanging is pulled back toward the closed position, the scissors 30 shift apart and the shifting element 42 shifts downward in the direction X until the closed position is reached. If the sheave 23 is preloaded, the shifting element 42 is slowed down by the building preload in the course of the closing process, since said element is connected to the sheave via a pulling means. Depending on the configuration of the preload, the closing of the hanging can be assisted by the gravitational force of the hanging. When the preloading element is suitably designed, the closing process can be self-locking so that the hanging can remain still in any desired position between the open position and the closed position.

In this way, a corresponding hanging consisting of slats 21 can be manually moved from an open position into a closed position, and vice-versa, using a relatively simple system. If a preloading element is used, this kind of adjustment is convenient and can protect the hanging consisting of slats 21 from damage.

Figure 7:
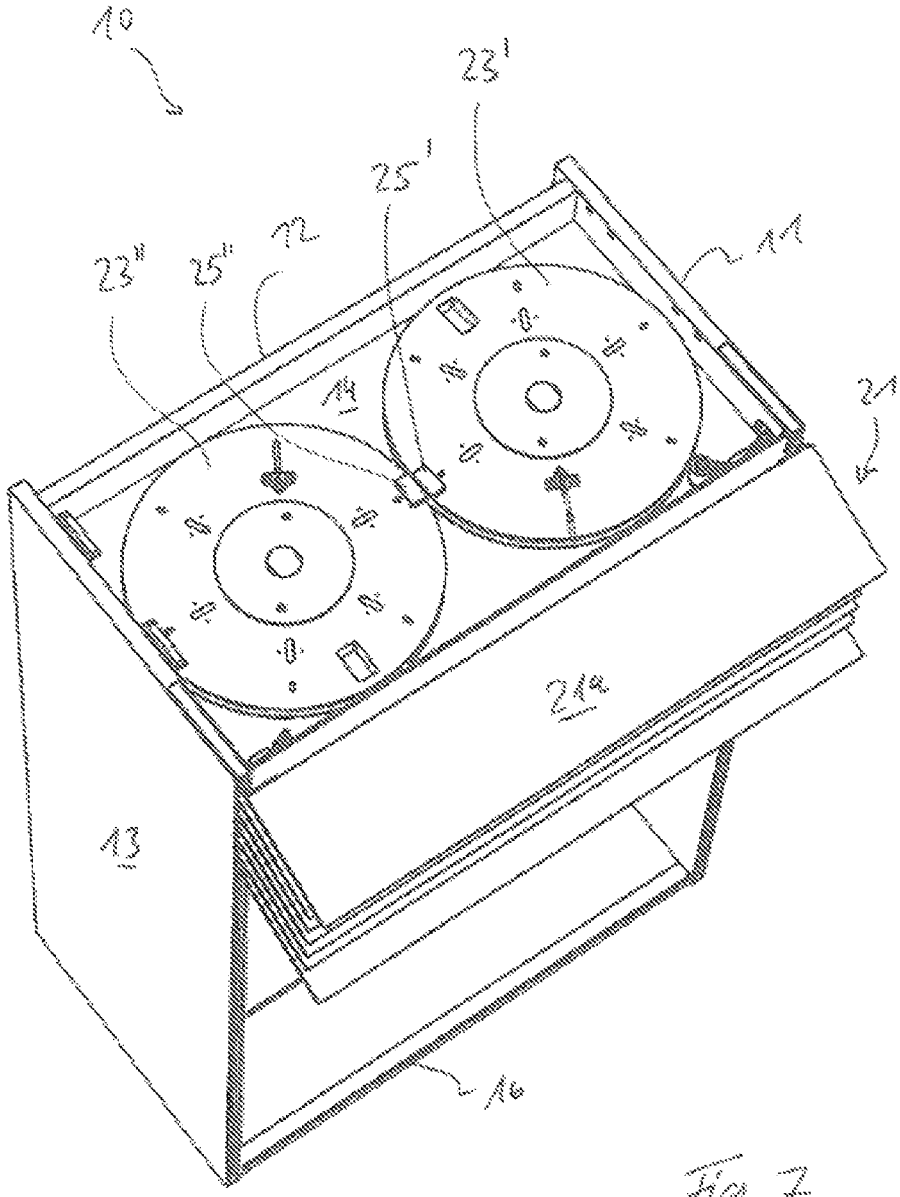
FIG. 7 shows an additional embodiment according to the invention comprising two sheaves.

The embodiment shown in FIG. 7 differs from the aforementioned embodiment only in that there is not only a sheave 23', but also an additional sheave 23" mounted on the upper face 14 of the cabinet 10. Each of the sheaves 23', 23" is then connected to one end of a pulling means, the other end of which is coupled to the hanging consisting of slats 21 in each case, as described above, for example. In this embodiment, there are therefore two lateral disks and two pulling means. The pulling means are guided on the two lateral walls 13 and 11 of the piece of furniture 10, for example in the manner described above. It is also possible here for the two sheaves to be correspondingly locked via locking means with respect to the upper face 14 in the open position. However, in this embodiment, the two sheaves 23', 23" preferably reciprocally hold one another in the open position. This is achieved by bringing about a magnetic interaction between the two sheaves 23', 23". Magnetic or magnetizable elements 25', 25", which are each located in a position so that they can face one another and magnetically attract one another when the piece of furniture 10 is in the open state, are preferably provided in the radially outer region of the sheaves for this purpose.

In order to support or lock the hanging in the closed position, a magnet can be arranged in or on the base 16, and at least the last slat of the hanging, i.e. the lowermost slat or the slat that is closest to the base 16 in the closed position, can have a magnetic or magnetizable component in all embodiments. In the closed position, as a result of the magnetic interaction between the base 16 of the cabinet 10 and the last slat, said slat is pulled toward the base 16. Of course, the magnetic component or the magnet can also be provided in or on the last slat, in which case a counter element that interacts with this magnet is correspondingly located on the base, for example a magnetic or magnetizable component or a correspondingly polarized magnet.

The invention claimed is:

1. A slat system (20), having a slat hanging which comprises a plurality of slats (21), said system also having a shifting apparatus (22*a*, 22*b*, 23) for shifting the slats (21), the plurality of slats (21) being intercoupled such that they can be moved from a closed position, in which the broad faces (21*a*) of the slats are substantially flush in a plane parallel to an opening and closing direction (X) and narrow faces (21*b*) of adjacent slats (21) face one another, into an open position, in which the broad faces (21*a*) of each of the slats (21) are parallel to one another but not parallel to the opening and closing direction (X), by means of the shifting apparatus (22*a*, 22*b*, 23) and by the slats (21) being shifted in the opening and closing direction (X); and the shifting apparatus (22*a*, 22*b*, 23) comprising a first pulling means (22*a*) and a second pulling means (22*b*), one end of each of said pulling means being connected to the slat hanging, wherein the slat system (20) further comprises:

a first sheave (23') which is mounted so as to be rotatable about an axis (A) in two directions (P1, P2), to which sheave the other end of the pulling means (22*a*, 22*b*) is fastened, at least one locking means (25, 26) which is designed to block the first sheave (23') from rotating in the open position being arranged on the first sheave (23');

a second sheave (23") which is mounted so as to be rotatable about an axis (A) in two directions (P1, P2), the other end of the first pulling means (22*a*) being fastened to the first sheave (23') and the other end of the second pulling means (22*b*) being fastened to the second sheave (23"); and at least one magnetic or magnetizable, locking means (25', 25') arranged on each of the sheaves (23', 23"), which locking means is designed to block relative rotation of the sheaves (23', 23") in the open position.

2. The slat system (20) according to claim 1, wherein one end of at least one pulling means (22*a*, 22*b*) is connected to a shifting element (42) that is coupled to the slat hanging.

3. The slat system (20) according to claim 1, wherein the slats (21) are intercoupled by means of a scissor transmission (30).

4. The slat system (20) according to claim 3, wherein the slats (21) are attached to lever extensions (33) which are arranged on levers (31) of the scissor transmission (30) that are guided parallel to one another, and which project toward a front (35) of the slat hanging.

5. The slat system (20) according to claim 3, wherein the shifting element (42) is coupled to the scissor transmission (30).

6. A slat system (20), having a slat hanging which comprises a plurality of slats (21), said system also having a shifting apparatus (22*a*, 22*b*, 23) for shifting the slats (21), the plurality of slats (21) being intercoupled such that they can be moved from a closed position, in which the broad faces (21*a*) of the slats are substantially flush in a plane parallel to an opening and closing direction (X) and narrow faces (21*b*) of adjacent slats (21) face one another, into an open position, in which the broad faces (21*a*) of each of the slats (21) are parallel to one another but not parallel to the opening and closing direction (X), by means of the shifting apparatus (22*a*, 22*b*, 23) and by the slats (21) being shifted in the opening and closing direction (X); and the shifting apparatus (22*a*, 22*b*, 23) comprising at least one pulling means (22*a*, 22*b*) which is coupled at one end to the slat hanging, wherein the slat system (20) further comprises a first sheave (23, 23') which is mounted so as to be rotatable about an axis (A) in two directions (P1, P2), to which first sheave (23, 23') the other end of the pulling means (22*a*, 22*b*) is fastened, at least one locking means (25, 26) which is designed to block the first sheave (23, 23') from rotating in the open position being arranged on the first sheave (23, 23'), wherein the at least one locking means (25, 26) comprises a magnet and/or a magnetizable, in particular ferromagnetic, material.

7. A slat system (20), having a slat hanging which comprises a plurality of slats (21), said system also having a shifting apparatus (22*a*, 22*b*, 23) for shifting the slats (21), the plurality of slats (21) being intercoupled such that they can be moved from a closed position, in which the broad faces (21*a*) of the slats are substantially flush in a plane parallel to an opening and closing direction (X) and narrow faces (21*b*) of adjacent slats (21) face one another, into an open position, in which the broad faces (21*a*) of each of the slats (21) are parallel to one another but not parallel to the opening and closing direction (X), by means of the shifting apparatus (22*a*, 22*b*, 23) and by the slats (21) being shifted in the opening and closing direction (X); and the shifting apparatus (22*a*, 22*b*, 23) comprising at least one pulling means (22*a*, 22*b*) which is coupled at one end to the slat hanging, wherein the slat system (20) further comprises a first sheave (23, 23') which is mounted so as to be rotatable about an axis (A) in two directions (P1, P2), to which first sheave (23, 23') the other end of the pulling means (22*a*, 22*b*) is fastened, at least one locking means (25, 26) which is designed to block the first sheave (23, 23') from rotating in the open position being arranged on the first sheave (23, 23')

wherein the locking means (25, 26) is designed to be adjustable and fixable in its position on the first sheave (23, 23') by means of a slotted guide system (25*a*, 26*a*) provided in the first sheave (23, 23').

8. The slat system (20) according to claim 1, wherein the first sheave (23') is coupled to a preloading element.

9. The slat system (10) according to claim 8, wherein the preloading element preloads the slat hanging such that said preloading element assists the movement of the slats (21) into the open position.

10. A cabinet (10), comprising a furniture body (11, 12, 13, 14, 15) and a frontal opening (16) and a slat system (20), having a slat hanging which comprises a plurality of slats (21), said system also having a shifting apparatus (2*a*, 22*b*, 23) for shifting the slats (21), the plurality of slats (21) being intercoupled such that they can be moved from a closed position, in which the broad faces (21*a*) of the slats are substantially flush in a plane parallel to an opening and closing direction (X) and narrow faces (21*b*) of adjacent slats (21) face one another, into an open position, in which the broad faces (21*a*) of each of the slats (21) are parallel to one another but not parallel to the opening and closing direction (X), by means of the shifting apparatus (22*a*, 22*b*, 23) and by the slats (21) being shifted in the opening and closing direction (X); and the shifting apparatus (22*a*, 22*b*, 23) comprising at least one pulling means (22*a*, 22*b*) which is coupled at one end to the slat hanging, wherein the slat system (20) further comprises at least one first sheave (23, 23') which is mounted so as to be rotatable about an axis (A) in two directions (P1, P2), to which sheave the other end of the pulling means (22*a*, 22*b*) is fastened, at least one locking means (25, 26) which is designed to block the sheave (23) from rotating in the open position being arranged on the sheave (23), and wherein the slat system (20) further a counter locking element (24), wherein the counter locking element (24), as well as the at least one locking means (25, 26) of the sheave (23), is attached to an upper face of the furniture body, wherein the counter locking element (24) interacts with the at least one locking means (25, 26) of the sheave (23) in order to establish a positional fixing of the slat hanging, wherein the slats (21) of the slat system (20) are arranged on the cabinet in such a way that, in the closed state, they close the frontal opening (16) of the cabinet (10).

11. The cabinet (10) according to claim 10, wherein the counter locking element (24) comprises a magnet and/or magnetizable material.

12. The cabinet (10) according to claim 10, wherein the sheave (23) is rotatably mounted on the furniture body.

13. The cabinet (10) according to claim 10, wherein the slat hanging is guided, by means of one or two scissor transmissions, in a guiding region (40) of the furniture body on one or both of the lateral walls (11, 13) that delimit the opening (16).

14. The cabinet (10) according to claim 10, wherein one end of at least one pulling means (22*a*, 22*b*) is connected to a shifting element (42) that is coupled to the slat hanging, and wherein the shifting element (42) is shiftably guided in the opening and closing direction (X) in at least one guide (41) that extends parallel to the opening and closing direction (X).

15. The cabinet (10) according to claim 10, wherein the at least one sheave (23, 23', 23") is mounted on a rotary bearing that is fastened to the upper face (14) of the furniture body, the rotary bearing having a motor connection flange to which a drive motor is fastened, and the motor shaft being coupled to the sheave (23, 23', 23").

16. The cabinet (20) according to claim 15, wherein an axis of rotation of the motor shaft extends parallel to an axis of rotation (A) of the sheave.

17. The slat system (20) according to claim 8, wherein the preloading element is a spiral spring.

18. The cabinet (10) according to claim 11, wherein the magnet and/or magnetizable material is a ferromagnetic material.

19. The cabinet (10) according to claim 12, wherein the sheave (23) is rotatably mounted on the upper face (14) of the furniture body.

20. The cabinet (20) according to claim 16, wherein an axis of rotation of the motor shaft and the axis of rotation (A) of the sheave are identical.

* * * * *